US007836655B2

(12) United States Patent
Chen et al.

(10) Patent No.: US 7,836,655 B2
(45) Date of Patent: Nov. 23, 2010

(54) BAMBOO FLOORING PLANKS WITH GLUELESS LOCKING SYSTEM

(75) Inventors: Yongjin Chen, Huzhou (CN); David Knight, Bainbridge Island, WA (US)

(73) Assignee: Teragren LLC, Bainbridge Island, WA (US)

( * ) Notice: Subject to any disclaimer, the term of this patent is extended or adjusted under 35 U.S.C. 154(b) by 559 days.

(21) Appl. No.: 11/860,401

(22) Filed: Sep. 24, 2007

(65) Prior Publication Data

US 2008/0141611 A1 Jun. 19, 2008

Related U.S. Application Data

(60) Provisional application No. 60/847,341, filed on Sep. 25, 2006.

(51) Int. Cl.
*E04B 2/00* (2006.01)

(52) U.S. Cl. ..... 52/592.1; 52/783.1; 52/796.1; 428/106

(58) Field of Classification Search ..... 428/106, 428/110

See application file for complete search history.

(56) References Cited

U.S. PATENT DOCUMENTS

| | | | |
|---|---|---|---|
| 3,493,021 | A | 2/1970 | Champigny |
| 3,723,230 | A | 3/1973 | Troutner |
| 4,061,819 | A | 12/1977 | Barnes |
| 4,146,123 | A | 3/1979 | Cottrell |
| 4,213,748 | A | 7/1980 | Ahrweiler |
| 4,232,067 | A | 11/1980 | Coleman |
| 4,255,477 | A | 3/1981 | Holman |
| 4,508,772 | A | 4/1985 | Churchland et al. |
| 4,704,316 | A | 11/1987 | Grace |
| 4,796,402 | A * | 1/1989 | Pajala ..... 52/390 |

(Continued)

FOREIGN PATENT DOCUMENTS

| | | |
|---|---|---|
| CN | 1037295 | 11/1989 |

(Continued)

OTHER PUBLICATIONS

Forestry Industry Standards of the People's Republic of China; LY/T 1073-92; "Test Methods for Physical and Mechanical Properties of Parallel Stacked Bamboo-Sliver Panel;" Sep. 9, 1992, pp. 1-5.

(Continued)

*Primary Examiner*—David Dunn
*Assistant Examiner*—Adam Barlow
(74) *Attorney, Agent, or Firm*—Perkins Coie LLP

(57) ABSTRACT

The present invention provides a 100% bamboo plank with an interlocking system and associated manufacturing methods. In one embodiment, the 100% bamboo plank comprises first, second, and third layers of 100% bamboo, wherein the layers are laminated together. The layers are independently preconditioned to control moisture content therein. Each layer can be preconditioned by alternately elevating and lowering the moisture content in a plurality of sequential cycles before the layers are laminated together. The middle layer is oriented so its grain is substantially perpendicular to the edges of the plank. The plank had joinery portions formed along the edges, and joinery includes an asymmetric upper joinery member and lower joinery member arrangement for, and at least a portion of the upper joinery member and lower joinery member portions are formed in the second layer.

17 Claims, 3 Drawing Sheets

U.S. PATENT DOCUMENTS

| | | | | |
|---|---|---|---|---|
| 4,810,551 | A | 3/1989 | Chu | |
| 5,456,964 | A | 10/1995 | Tamura et al. | |
| 5,543,197 | A | 8/1996 | Plaehn | |
| 5,675,951 | A | 10/1997 | Gow | |
| 5,976,644 | A | 11/1999 | Sanaee et al. | |
| 6,182,413 | B1 * | 2/2001 | Magnusson | 52/589.1 |
| 7,021,346 | B2 * | 4/2006 | Chang | 144/333 |
| 7,152,379 | B2 * | 12/2006 | Lin et al. | 52/403.1 |
| 7,225,591 | B2 * | 6/2007 | Lin et al. | 52/403.1 |

FOREIGN PATENT DOCUMENTS

| | | |
|---|---|---|
| CN | 0103257 | 7/1991 |
| CN | 1068536 | 2/1993 |
| CN | 1108724 | 9/1995 |
| CN | 1133929 | 10/1996 |
| CN | 1284424 | 2/2001 |
| CN | 1443036 | 9/2003 |
| CN | 1654180 | 8/2005 |
| CN | 1672884 | 9/2005 |
| CN | 1788955 | 6/2006 |
| GB | 353186 | 7/1931 |
| JP | 6-293008 | 10/1994 |
| JP | 7-047509 | 2/1995 |
| JP | 7-195313 | 8/1995 |
| JP | 7-217055 | 8/1995 |
| JP | 2001-030207 | 2/2001 |
| JP | 2005-088236 | 4/2005 |
| JP | 2005-103936 | 4/2005 |
| KR | 10-2004-0033351 | 4/2004 |
| TW | 431956 | 5/2001 |
| WO | WO-2005/098164 | 10/2005 |
| WO | WO-2005/103432 | 11/2005 |

OTHER PUBLICATIONS

International Search Report and Written Opinion for PCT/US2007/079434; Teragren LLC; Apr. 2, 2008; pp. 1-11.

The Peoples Republic of China Forestry Trade Standard; LY/T 1072-92; "Technical Conditions of Parallel Stacked Bamboo-Sliver Panel;" Sep. 9, 1992; pp. 1-5.

* cited by examiner

BAMBOO FLOORING PLANKS WITH GLUELESS LOCKING SYSTEM

CROSS REFERENCE TO RELATED APPLICATION

The present application claims priority under 35 U.S.C. 119(e) to U.S. Provisional Application Ser. No. 60/847,341, filed Sep. 25, 2006, the disclosure of which is incorporated herein by reference in its entirety.

TECHNICAL FIELD

The present invention is related to bamboo planks, and more particularly to laminated bamboo planks and related methods.

BACKGROUND

Conventional flooring planks used as floor boards are made of a wood or similar substrate material with a bamboo face layer. Other flooring planks are made of 100% bamboo fibers. These bamboo flooring planks are formed by sheets of bamboo fibers, wherein the sheets are laminated together to provide a sturdy, solid bamboo plank. One problem experienced by these conventional flooring planks is that the bamboo and wood or similar materials absorb moisture at different rates thereby creating a moisture imbalance in the flooring plank. The moisture imbalance can cause the flooring to cup, buckle, expand, and contract over time to levels that are generally unacceptable. As a result, the flooring planks of the prior art often are not able to remain flat during or after the manufacturing process or after installation of the planks to form a floor. These flooring planks are also susceptible to surface cracks, known as checking, which can affect the appearance and durability of the flooring planks over time.

Bamboo is a fibrous material that has a longitudinal grain. Some conventional flooring planks are solid bamboo, but they break relatively easily due to layers in which all the bamboo fibers are aligned in the same direction along the length of the plank, including along the edges. The formation process of these flooring planks includes machining the edge portions to form a locking system, such as tongue and groove or glueless interlocking systems that have thin portions. These thin portions are not sufficiently strong and they can be susceptible to breakage along the grain. As such, when an installer places two flooring planks together side-by-side during installation, the pressure on the engaging edge portions can cause one or both edges to break or crack. Such breakage and cracking creates unusable flooring boards, or unusable portions of the floor boards, thereby creating unwanted waste.

SUMMARY

The present invention provides a 100% bamboo plank with an integral locking system and associated manufacturing methods that overcome drawbacks experienced in the prior art and provides additional benefits. The 100% bamboo plank in accordance with an embodiment comprises first, second, and third layers of 100% bamboo, wherein the layers are laminated together. The bamboo fibers of the first layer are generally parallel to each other to form a first grain. In one embodiment, the first layer has been preconditioned to control moisture content therein, resulting in a first moisture content upon completion of the precondition. The first layer is preconditioned by elevating and lowering the moisture content in the first layer during a first plurality of sequential cycles before the first layer is laminated with the second and third layers.

The second layer has a length and second plurality of bamboo fibers oriented generally parallel to each other to form a second grain substantially perpendicular to the length. The second layer has been preconditioned to control moisture content therein, resulting in a second moisture content upon completion of the preconditioning. The second layer is preconditioned by alternately elevating and lowering the moisture content in the second layer during a second plurality of sequential cycles and before the second layer is laminated with the first and third layers. The second layer has a first edge portion with a first locking joinery portion, and has a second edge portion and a second locking joinery portion shaped and sized to lockably interconnect with a first joinery portion of an adjacent similar bamboo plank. The third layer has a third plurality of bamboo fibers oriented generally parallel to each other to form a third grain at a selected orientation relative to the second grain.

In another embodiment, a bamboo flooring system is provided. The bamboo flooring system has a plurality of interconnectable laminated bamboo flooring planks. Each of the bamboo flooring planks comprising first, second and third layers of 100% bamboo laminated together. The first layer has a first plurality of bamboo fibers that form a first grain. The first layer has a first thickness and a first moisture content therein.

The second layer has a length and second plurality of bamboo fibers that form a second grain, wherein the second grain is substantially perpendicular to the length of the second layer. The second grain can be cross-plied relative to the first grain. The second layer has a second thickness different than the first thickness. The second layer is preconditioned to control moisture content in the second layer to result in a second moisture content upon completion of the preconditioning. The second layer is preconditioned by adjusting the moisture content in a plurality of sequential cycles to result in the second moisture content before the second layer is laminated with the first and third layers. The second layer has a first edge portion with a first interlocking member and a second edge portion with a second interlocking member shaped and sized to lockably interconnect with a first interlocking member of another similar bamboo plank. In one embodiment, a thin portion of the first interlocking member is formed in the second layer, and that portion is connected to the third layer and has a thickness of at least 0.1 millimeter.

The third layer has a third plurality of bamboo fibers oriented generally parallel to each other to form a third grain of the layer. The third grain can be cross-plied relative to the second grain, wherein the third grain is cross-plied with the thin portion of the first interlocking member of the second layer.

DETAILED DESCRIPTION

The present disclosure describes 100% bamboo flooring planks and associated methods of use and methods of manufacture. Several specific details of the invention are set forth in the following description and in FIGS. 1-4 to provide a thorough understanding of certain embodiments of the invention. One skilled in the art, however, will understand that the present invention may have additional embodiments, and that other embodiments of the invention may be practiced without several of the specific features described below.

Figure 1:
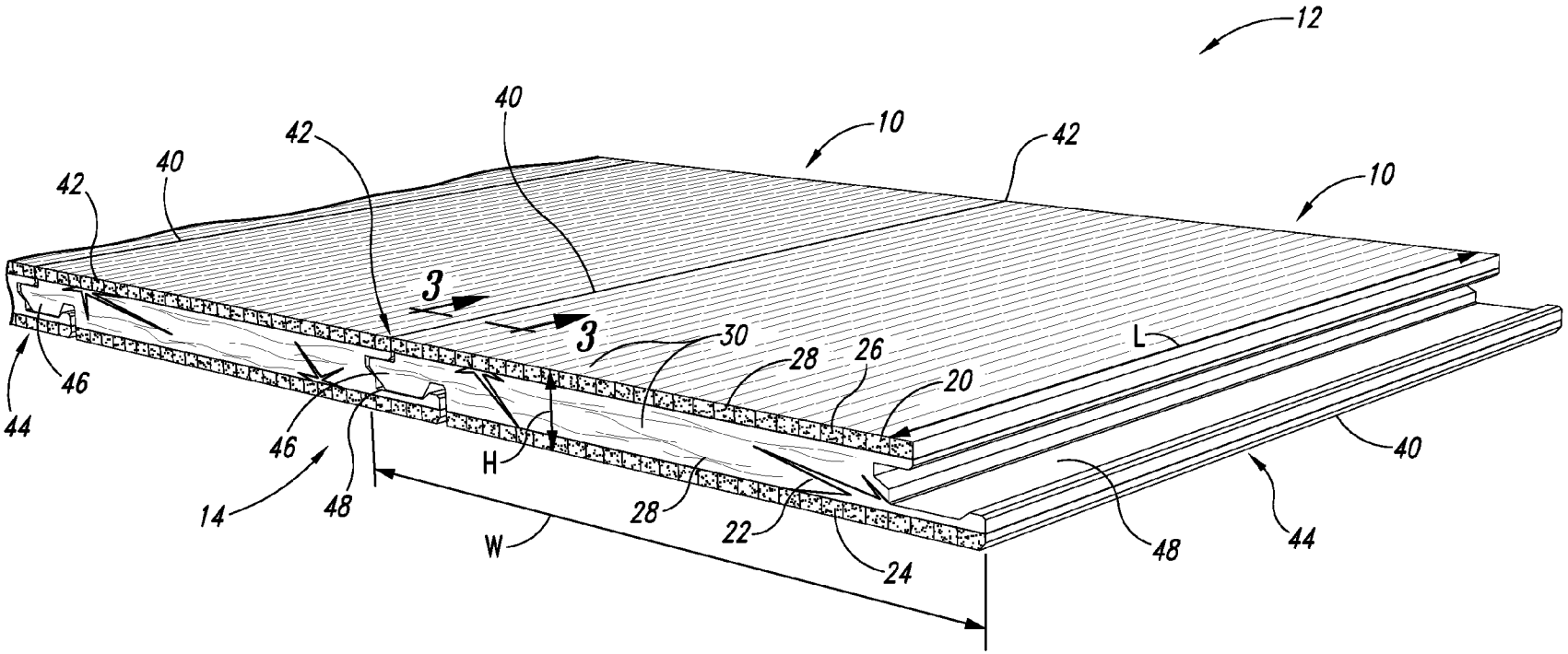
FIG. 1 is a schematic isometric view of a pair of interconnected 100% bamboo flooring planks in accordance with an embodiment of the present invention.
Figure 2:
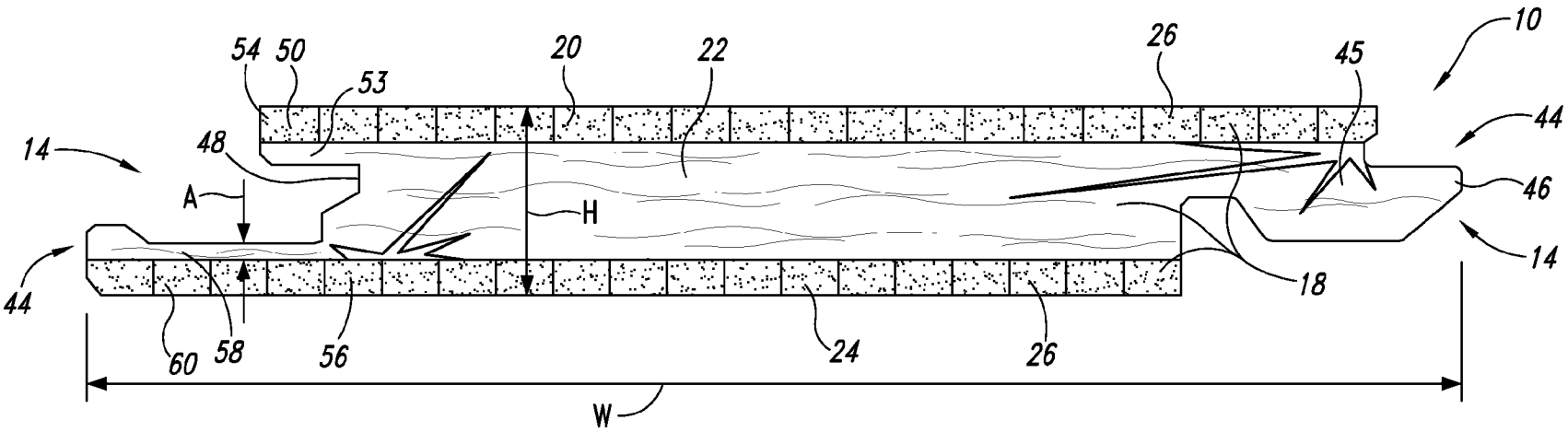
FIG. 2 is an enlarged side elevation view of a bamboo flooring plank of FIG. 1.

FIG. 1 illustrates a pair of 100% bamboo fiber flooring planks 10 in accordance with an embodiment of the present invention and shown joined together to form a portion of a bamboo floor 12. FIG. 2 is an enlarged side elevation view of a bamboo flooring plank of FIG. 1. The bamboo planks 10 have integral joinery 14 that provides a glueless locking system (also referred to as a click or mechanical locking system), as discussed in greater detail below. The planks 10 of the illustrated embodiment are made from 100% bamboo fibers without using wood fibers or wood fillers. The planks of the illustrated embodiment include three layers 18 formed by layers of 100% bamboo laminated together. For purposes of discussion, the three layers will be described as a top layer 20 (also referred to as a face or wear layer), a middle layer 22, and a bottom layer 24. The middle and bottom layers are also referred to as core or substrate layers. This reference to top, middle and bottom are from perspective illustrated in the Figures, but are not intended to define a required special orientation of the planks in accordance with the present invention.

Each layer 18 includes 100% bamboo fiber slats 26 of various lengths laminated together with an adhesive or other suitable binder that provides the desired bonding, curing, and moisture resistance characteristics. The bamboo fibers 28 of the slats 26 forming the layer are generally parallel to each other, thereby forming a grain 30 in each layer 18. The top layer 20, the middle layer 22, and the bottom layer 24 are laminated together so that the grains of adjacent layers are cross-plied. In the illustrated embodiment, the top layer 20 is oriented so its grain 30*a* is substantially perpendicular to the grain 30*b* of the middle layer 22. Similarly, the bottom layer 24 is oriented so its grain 30*c* is substantially perpendicular to the grain 30*b* of the middle layer 22. In other embodiments, top, middle, and/or bottom layers 20, 22, and 24 can be oriented so the grains 30*a*, 30*b*, and/or 30*c* are cross-plied at other selected angles relative to the grain of an adjacent layer. As discussed in greater detail below, the face and core layers are formed, preconditioned and then laminated together. The layers in one embodiment use the same or similar adhesive or binder as the adhesive or binder used to join the slats 26 together.

In the illustrated embodiment, the flooring planks 10 are elongated members having a length L, a width W, and a height H. The top and bottom layers 20 and 24 are oriented so the grains 30*a* and 30*c* run substantially parallel with the length L of the flooring plank 10. The middle layer 22 is oriented so the grain 30*b* runs substantially perpendicular to the length L of the flooring plank 10. In another embodiment, the top or face layer 20 can be oriented such that grain 30*a* runs perpendicular to the length L of the flooring plank 10.

Figure 3:
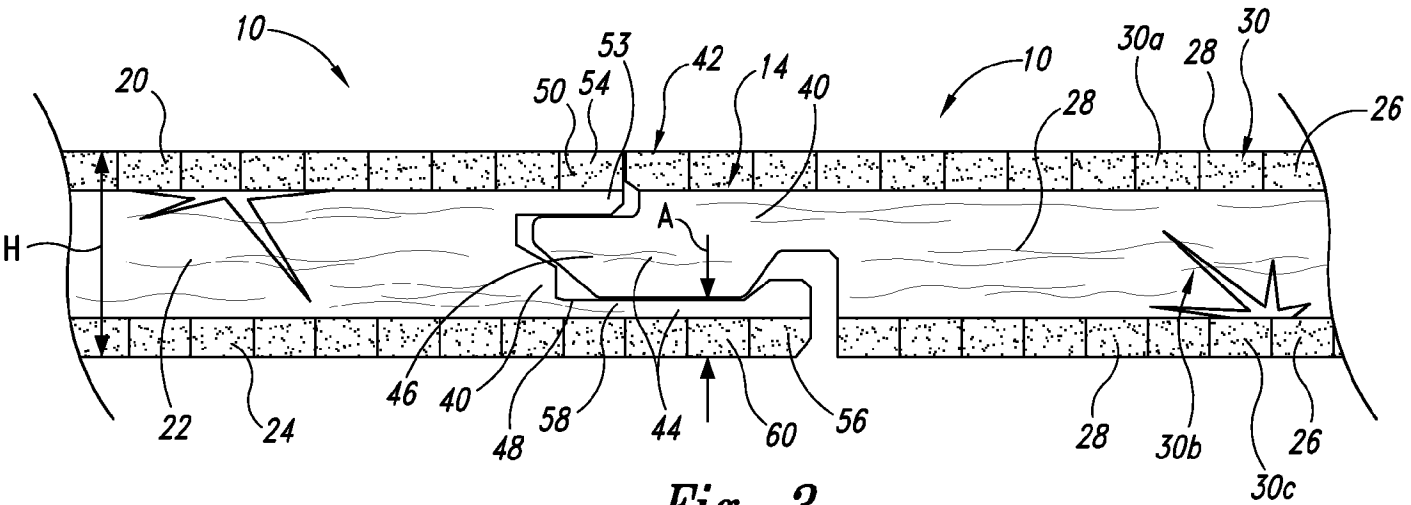
FIG. 3 is an enlarged cross-sectional view of a bamboo flooring plank taken substantially along lines 3-3 of FIG. 1.

Each flooring plank 10 has longitudinal edge portions 40 that extend between end portions 42. As best seen in FIGS. 2 and 3, the edge portions 40 include opposing joinery portions 44 configured to interlock with joinery portions of adjacent planks, such as when the planks are joined together to form a floor or other surface. In the illustrated embodiment, the joinery portions 42 include an asymmetric locking system 16, wherein an upper joinery member 46 extends along one edge portion 40 and the corresponding lower joinery member 48 extends along the other edge portion. The upper joinery member 46 and lower joinery member 48 of the illustrated embodiment are formed so that the upper joinery member on one flooring plank 10 will lockably mate with the lower joinery member of an adjacent flooring plank to securely hold the adjacent planks together without requiring additional adhesives, nails, fasteners, or other interlocking mechanisms.

In the illustrated embodiment, the upper joinery member 46 and the lower joinery member 48 have asymmetric shapes at least partially formed in the middle layer 22 of the flooring plank 10, such that the majority of the upper and lower joinery members are formed in the bamboo material wherein the grain of the layer is substantially perpendicular to the edge portion 40 of the plank. This grain arrangement provides strength to the joinery and is resistant to cracking or breaking along a plane generally parallel to the edge portion. In the illustrated embodiment, the grain 30*b* of the middle layer 22 is cross-plied (e.g. substantially perpendicular) relative to the grain 30*a* of the top layer 20 and/or the grain 30*c* of the bottom layer 24. The majority 45 of the upper joinery member 46 is machined into the edge portion of the middle layer 22, such that the grain of the projecting upper joinery member is substantially perpendicular to the edge of the plank 10. In the illustrated embodiment, an upper portion of the upper joinery member 46 is formed by an edge portion of the top layer 20 laminated to an edge portion of the middle layer 22. Accordingly, upper joinery member 46 of the illustrated embodiment is a cross-plied structure projecting from the body of the flooring plank 10 that provides a very strong, durable and break resistant joinery structure.

The lower joinery member 48 on the other edge of the plank 10 is defined by spaced apart upper and lower shoulders 50 and 56. More specifically, the top of the lower joinery member 48 of the illustrated embodiment is defined by a short upper shoulder 50 formed by a thin upper edge portion 52 of the middle layer 22 and an edge portion 54 of the top layer 22. The bottom of the asymmetric lower joinery member 48 of the illustrated embodiment is defined by a longer bottom shoulder 56 formed by a thin bottom edge portion 58 of the middle layer 22 and an edge portion 60 of the bottom layer 22. Accordingly, the upper and lower shoulders 50 and 56 of the lower joinery member 48 in the illustrated embodiment are both laminated, cross-plied structures that provides a very strong, durable and break resistant lower joinery member that can securely receive a mating upper joinery member 46 of an adjacent flooring plank 10, such as during installation of a floor 12 or the like.

In the illustrated embodiment, the edge portion 40 of the plank 10 is milled to the tolerances of the locking system's profile. The lower joinery member 48 is formed by milling the edge portion so that the thin bottom edge portion 54 of the lower joinery member's bottom shoulder has a thickness A of at least approximately 0.1 millimeter. This laminated, cross-plied structure has the strength and elasticity to avoid breaking or cracking during installation and use.

During manufacture of the flooring planks 10, the bamboo layers 18 are placed in one or more presses to glue the layers together into the laminated bamboo plank 10 (as discussed in greater detail below). The plank 10 is then milled to make the unfinished product (referred to as an "UF" or "site finished" product) or prefinished product (referred to as a "PF" product). For example, one side and/or one end of the flooring plank 10 is milled to form the upper joinery member 46. The opposite side and/or opposite end of the flooring plank 10 is milled to form the lower joinery member 48. To connect two or more flooring planks together, the upper joinery member of one plank is inserted into the lower joinery member of another flooring plank. Due to the milling tolerances the planks "lock" or "click" together. No glue or binder is required to hold the planks together once "locked".

In a flooring plank that includes only bamboo and binder, the inventors discovered that balancing and controlling the moisture content in the layers 18 of the plank help to create a more stable flooring plank that will remain substantially flat over time without cupping, buckling, expanding, or contracting to any meaningful degree. This balancing and controlling the moisture content of the layers 18 also provides a face layer that is more resistant to checking (i.e. cracking and/or chipping) during use over time. Therefore, in several embodiments, the floor plank can include 100% bamboo fiber material without any wood material. The process for manufacturing the flooring plank 10, however, can be applied to a plank that includes selected wood material, including a wood or wood-based layer (such as a top layer) laminated to bamboo layers. For example, in alternate embodiments, the face layer can be made of wood or similar materials like straw, palm, kempas, etc, and the face layer is laminated to the bamboo substrate layers.

Figure 4:
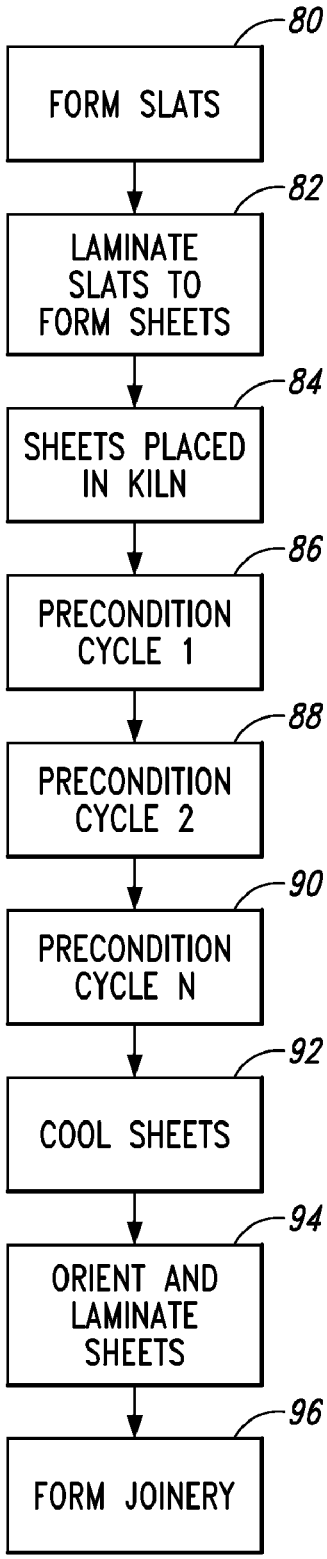
FIG. 4 is a schematic illustration of a manufacturing sequence for making the bamboo flooring planks of FIG. 1.

In one embodiment, the flooring plank 10 is manufactured in stages. With reference to FIG. 4, the bamboo materials with the elongated fibers are formed in element 80 into the slats 26 using a conventional hot press or cold press technique and milling processes. The slats are laminated together in a press machine in element 82 to form a sheet of bamboo having a selected thickness H. In the illustrated embodiment shown in FIGS. 2 and 3, the sheet forming the middle layer 22 is thicker than the sheets forming the top and bottom layers 20 and 24. The top layer 20 can also have a different thickness than the bottom layer 24, as shown in FIG. 3. In the illustrated embodiment, the top layer 20 is thicker than the bottom layer 24, and the middle layer 22 is thicker than the top layer. When the individual bamboo sheets are removed from the press, the sheets have an initial moisture content therein. The thicker sheets typically have a higher moisture content than the thinner sheets. As an example, a bamboo sheet made of approximately 5- to 6-year old bamboo and having a thickness in the range of 4 millimeters typically has a moisture content in the range of approximately 6%-10%. Thinner sheets, which contain less bamboo typically, have a lower moisture content.

In one embodiment each sheet is then placed in a kiln in element 84 and dried in a manner so as to precondition the sheets before they are laminated together to form the layers 18 of the plank 10. In one embodiment, each sheet is preconditioned in an adjustable kiln in elements 86, 88, and 90 by alternately elevating and lowering the layer's moisture content over first plurality of sequential cycles. The environment within the kiln is adjustable so as to closely control the temperature and humidity within the kiln. For example, a layer having an initial moisture content of approximately 7%-9% is conditioned in a first cycle in the kiln at a controlled temperature and over a selected time period until the moisture content in the layer is elevated to approximately 11%-14%. The temperature, humidity and time for this conditioning step is dependent upon several factors, such as the kiln, the number of sheets in the kiln, and the initial moisture content of the bamboo sheets.

The humidity, temperature, and/or other kiln conditions are adjusted and the moisture content within the sheet is lowered in another cycle, for example, to approximately 8%-11%. The kiln conditions are again adjusted in another cycle, such that the sheet's moisture content is further adjusted. In one embodiment, the sheet is conditioned in the second cycle at a selected temperature and for a time period to lower the moisture content at a first rate. In a third cycle, the temperature in the kiln is adjusted (e.g., lowered) and the sheet is conditioned in another cycle for another time period and a selected temperature within the kiln so as to further adjust the moisture content at a different rate (e.g. a slower rater). In one embodiment, the temperature in the kiln for the second cycle is in the range of approximately 40° C., and the time period is in the range of at least 10 hours. In the third cycle, the temperature in the kiln is in the range of approximately 42° C., and the time period is in the range of approximately 36 to 48 hours. Other embodiments can use different temperatures and time periods. After the second cycle, the moisture content is in the range of approximately 8%-11%, and after the third cycle, the moisture content is in the range of approximately 6%-9%.

In another embodiment, the moisture content of the sheet can be cycled up and down a plurality of times. For example, the moisture content in the sheet can be elevated from the initial level of approximately 7%-9% to approximately 11%-14%. The kiln conditions are adjusted and the moisture content of the sheet is reduced to a lowered level, such as to approximately 6%-9%. The sheet's moisture content is then elevated again to another elevated level, such as to approximately 10%-14%. The kiln conditions are again adjusted in another cycle, such that the sheet's moisture content is reduced to a lowered level, such as to approximately 6%-9%. The sheet can be conditioned through a greater or fewer number of cycles in other embodiments. Before the sheet is removed from the kiln, the sheet's moisture content is normalized to approximately 7%-9%. The sheet is then removed from the kiln and allowed to cool. In one embodiment, the sheet is cooled in element 92 by allowing it to cool naturally to room temperature without applying forced cooling techniques, such as forced air cooling or other techniques.

This process of preconditioning the sheets that will form the layers 18 before the layers are laminated together provides more durable bamboo layers, and a more durable plank that remains flat after formation of the plank, such that the plank remains flat and is resistant to cupping, bowing or other deformation over time. In one embodiment, all of the sheets are preconditioned before being laminated together to form the plank. In another embodiment, less than all of the sheets are preconditioned. For example, in one embodiment, only the middle sheet is preconditioned as described above. The preconditioning process allows the stresses within the bamboo fibers in the sheet to normalize during the manufacturing process so that the plank will be flat and will remain flat over time (e.g. during storage or after installation). This preconditioning of the layer(s) also enables the manufacturers to make wider flooring planks that will remain flat and check resistant over time, which is something that the prior art processes could not adequately accomplish.

In the illustrated embodiment, the plank 10 is formed by selecting three bamboo sheets of desired thicknesses that will be used for the top, middle and bottom layers 20, 22, and 24. In the illustrated embodiment, the three layers are oriented in element 94 so the grain 30*b* of the middle layer will be substantially perpendicular to the edge portion of the resulting plank, and the grain 30 of the top and bottom layers 20 and 24 are cross-plied relative to the grain of the middle layer 22, as discussed above. Adhesive is applied to the three layers, and the layers are placed in a press and laminated together under heat and pressure to form the laminated plank 10. The plank is removed from the press, allowed to cool, and then the edges are milled in element 96 to form the joinery discussed above. The resulting plank 10 provides a very durable, flat and break resistant floor board with an integral glueless locking system.

The description of embodiments of the invention is not intended to be exhaustive or to limit the invention to the precise form disclosed. While specific embodiments of, and examples for, the invention are described herein for illustrative purposes, various equivalent modifications are possible within the scope of the invention, as those skilled in the relevant art will recognize. For example, while certain features are presented above in a given order, alternative embodiments may include such features in a different relationship than that described above. The teachings of the invention provided herein can be applied to other products, not only the floor boards described herein. The various embodiments described herein can be combined to provide further embodiments. Further, aspects of the invention can be modified, if necessary, to employ the features described above in yet further embodiments. These and other changes can be made in the invention in light of the above detailed description.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A bamboo flooring plank comprising:

first, second and third layers of 100% bamboo laminated together, wherein:

the first layer having a first plurality of bamboo fibers oriented generally parallel to each other to form a first grain of the layer, the first layer having been preconditioned to a first moisture content upon completion of preconditioning, wherein the moisture content of the first layer is preconditioned by alternately lowering and elevating the moisture content in a first plurality of sequential cycles before the first layer is laminated with the second and third layers;

the second layer of having length and a second plurality of bamboo fibers oriented generally parallel to each other to form a second grain of the layer, wherein the second grain is substantially perpendicular to the length, the second layer having been preconditioned to a second moisture content upon completion of preconditioning, wherein the second layer is preconditioned by alternately lowering and elevating in a second plurality of sequential cycles different than the first plurality of sequential cycles before the second layer is laminated with the first and third layers, the second layer having a first edge portion with a first locking joinery portion, and having a second edge portion, a second locking joinery portion shaped and sized to lockably interconnect with a first joinery portion of another bamboo plank; and the third layer having a third plurality of bamboo fibers oriented generally parallel to each other to form a third grain of the layer, the third layer having been preconditioned to a third moisture content of the third layer upon completion of preconditioning, wherein the third layer is preconditioned by alternately lowering and elevating the moisture content in a third plurality of sequential cycles before the third layer is laminated with the first and second layers, wherein the first and second moisture contents are different upon completion of the first and second layers being preconditioned and before the first, second and third layers are laminated together.

2. The bamboo flooring plank of claim 1 wherein the first, second and third moisture contents are different from each other upon completion of the first, second, and third layers being preconditioned and before the first, second and third layers are laminated together.

3. The bamboo flooring plank of claim 1 wherein the first layer has a first thickness and the second layer has a second thickness different than the first thickness.

4. The bamboo flooring plank of claim 1 wherein the second locking joinery portion has a substantially planer projecting portion formed in the second layer having a thickness of at least approximately 0.10 mm.

5. The bamboo flooring plank of claim 1 wherein the first and second joinery portions have a grain substantially perpendicular to the first and second edges.

6. The bamboo flooring plank of claim 5 wherein the second locking joinery portion is a lower joinery member.

7. The bamboo flooring plank of claim 1 wherein the first grain is cross-plied relative to the second grain.

8. The bamboo flooring plank of claim 1 wherein the first grain is substantially perpendicular to the second grain.

9. The bamboo flooring plank of claim 1 wherein the second grain is cross-plied relative to the third grain.

10. A bamboo flooring system comprising a plurality of interconnectable laminated bamboo flooring planks, each of the bamboo flooring planks comprising first, second and third layers of 100% bamboo laminated together, wherein:

the first layer having a first plurality of bamboo fibers oriented generally parallel to each other to form a first grain of the layer, the first layer having a first thickness and having been preconditioned to have a first moisture content upon completion of preconditioning, wherein the moisture content of the first layer is preconditioned by alternately adjusting the moisture content in a first plurality of sequential cycles before the first layer is laminated with the second and third layers;

the second layer of having a length and second plurality of bamboo fibers oriented generally parallel to each other to form a second grain of the layer, wherein the second grain is substantially perpendicular to the length, the second layer having a second thickness different than the first thickness, the second layering having been preconditioned to a second moisture content, wherein the second layer is preconditioned by alternately adjusting in a second plurality of sequential cycles different than the first plurality of sequential cycles before the second layer is laminated with the first and third layers, the second layer having a first edge portion with a first interlocking member, and having a second edge portion a second interlocking member shaped and sized to lockably interconnect with a first interlocking member of another bamboo plank; and the third layer of having a third plurality of bamboo fibers oriented generally parallel to each other to form a third grain of the layer, the third layer having a third thickness different than the second thickness, the third layer being preconditioned to a third moisture content, wherein the third layer is preconditioned by alternately adjusting in a third plurality of sequential cycles before the third layer is laminated with the first and second layers, wherein the first moisture content is different than the second moisture content upon completion of the first and second layers being preconditioned and before the first, second and third layers are laminated together.

11. The bamboo flooring system of claim 10 wherein the second moisture content is different than the third moisture content upon completion of the second and third layers being preconditioned and before the first, second and third layers are laminated together.

12. The bamboo flooring system of claim 10 wherein the second locking joinery portion has a substantially planer projecting portion formed in the second layer having a thickness of at least approximately 0.10 mm.

13. The bamboo flooring system of claim 10 wherein the first and second joinery portions have the second grain therein substantially perpendicular to the first and second edges.

14. The bamboo flooring system of claim 13 wherein the second locking joinery portion Is a lower joinery member.

15. The bamboo flooring system of claim 1 wherein the first grain is cross-plied relative to the second grain.

16. The bamboo flooring system of claim 1 wherein the first grain is substantially perpendicular to the second grain.

17. A bamboo flooring plank comprising:

first, second and third layers of 100% bamboo laminated together, wherein:

the first layer having a first plurality of bamboo fibers oriented generally parallel to each other to form a first grain of the layer, the first layer having been preconditioned to a first moisture content upon completion of preconditioning, wherein the moisture content of the first layer is preconditioned by alternately lowering and elevating the moisture content in a first plurality of sequential cycles before the first layer is laminated with the second and third layers;

the second layer of having length and a second plurality of bamboo fibers oriented generally parallel to each other to form a second grain of the layer, wherein the second grain is substantially perpendicular to the length, the second layer having been preconditioned to a second moisture content upon completion of preconditioning, wherein the second layer is preconditioned by alternately elevating and lowering in a second plurality of sequential cycles different than the first plurality of sequential cycles before the second layer is laminated with the first and third layers, the second layer having a first edge portion with a first locking joinery portion, and having a second edge portion, a second locking joinery portion shaped and sized to lockably interconnect with a first joinery portion of another bamboo plank, wherein the second locking joinery portion has a substantially planer projecting portion formed in the second layer having a thickness of at least approximately 0.10 mm; and the third layer having a third plurality of bamboo fibers oriented generally parallel to each other to form a third grain of the layer, wherein the first and second moisture contents are different upon completion of the first and second layers being preconditioned and before the first, second and third layers are laminated together.

* * * * *